US005879191A

United States Patent [19]

Burris

[11] Patent Number: 5,879,191

[45] Date of Patent: Mar. 9, 1999

[54] ZIP-GRIP COAXIAL CABLE F-CONNECTOR

[75] Inventor: Donald A. Burris, Peoria, Ariz.

[73] Assignee: Gilbert Engineering Co, Inc., Glendale, Ariz.

[21] Appl. No.: 980,946

[22] Filed: Dec. 1, 1997

[51] Int. Cl.[6] ..... H01R 9/05

[52] U.S. Cl. ..... 439/584; 439/585; 439/271

[58] Field of Search ..... 439/98, 578–585, 439/271, 278, 281, 610, 877; 29/842, 844, 845

[56] References Cited

U.S. PATENT DOCUMENTS

| | | | |
|---|---|---|---|
| 3,587,033 | 6/1971 | Brorein et al. | 128/214 R |
| 4,156,554 | 5/1979 | Aujla | 604/284 |
| 4,400,050 | 8/1983 | Hayward | 604/43 |
| 4,408,822 | 10/1983 | Nikitas | 604/280 |
| 4,575,274 | 3/1986 | Hayward | 604/43 |
| 4,674,818 | 6/1987 | McMills et al. | 128/674 |
| 4,755,152 | 7/1988 | Elliot et al. | 604/63 |
| 4,834,675 | 5/1989 | Samchisen | 604/43 |
| 4,990,106 | 2/1991 | Szedga | 604/43 |
| 5,295,864 | 3/1994 | Birch et al. | 604/43 |
| 5,318,458 | 6/1994 | Thorner | 604/164 |
| 5,470,257 | 11/1995 | Szegda | 439/578 |

*Primary Examiner*—Khiem Nguyen
*Attorney, Agent, or Firm*—Cahill, Sutton & Thomas, PLC

[57] ABSTRACT

An F-connector for terminating the end of a coaxial drop cable includes a tubular post and fastening nut, along with a modified form of body member. The body member outer wall includes a series of annular ridges, and the end of the body member includes a beveled surface. The F-connector includes a collar assembly that incorporates a gripping ring. The collar assembly has a central passage for receiving the end of the coaxial cable. One end of the collar assembly has an internal bore of a diameter commensurate with the outer diameter of the body member; the internal bore also has annular ridges formed thereon which frictionally engage the ridges on the outer wall of the body member. A compression tool longitudinally compresses the collar assembly over the body member during installation, causing the beveled surface of the body member to cam the gripping ring inwardly toward the tubular post, securing the outer jacket and conductive braid of the coaxial cable therebetween.

21 Claims, 3 Drawing Sheets

ZIP-GRIP COAXIAL CABLE F-CONNECTOR

BACKGROUND OF THE INVENTION

1. Field of the Invention

The present invention relates generally to so-called F-connectors used primarily in the cable television industry to connect coaxial cables to threaded ports, and more particularly to such F-connectors that are installed using an axial compression tool.

2. Description of the Related Art

Coaxial cable F-connectors are often used to terminate a drop cable in a cable television. system. The coaxial cable typically includes a center conductor surrounded by a dielectric, in turn surrounded by a conductive foil/grounding braid; the conductive foil/grounding braid is itself surrounded by a protective outer jacket The F-connector is secured over the prepared end of the jacketed coaxial cable, allowing the end of the coaxial cable to be threadedly connected with a threaded port of a terminal block.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable. Examples of such crimp connectors are disclosed within U.S. Pat. No. 4,400,050 to Hayward, assigned to Gilbert Engineering Co., Inc.; and U.S. Pat. No. 4,990,106 to Szegda, assigned to John Mezzalingua Assoc. Inc.

It is known in the art that the passage of moisture between the coaxial cable jacket and the surrounding F-connector can lead to corrosion, increased contact resistance, reduced signal strength, and excessive RF leakage from the connector. Those skilled in the art have made various efforts to form a seal between the F-connector and the jacket of the coaxial cable to preclude such moisture ingress. F-connectors are known in the cable television industry wherein special sealing compounds are included in an effort to form leak-proof seals. For example, U.S. Pat. No. 4,755,152 to Elliot, et al., and assigned to Tele-Communications, Inc. discloses a crimp connector incorporating a glob of a gel or other movable sealing material within a cavity of the connector to form a seal between the jacket of the coaxial cable and the interior of the F-connector.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for allowing such compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen and assigned to LRC Electronics, Inc.; such patent discloses a compression sleeve type F-connector known in the industry as "Snap-n-Seal". A number of commercial tool manufacturers provide compression tools for axially compressing the compression sleeve into such connectors; for example, the CablePrep division of Ben Hughes Communication Products Company of Chester, Connecticut sells such a hand-operated compression tool under the commercial designation "Terminx".

The aforementioned "Snap-n-Seal" compression connector requires substantial manipulation by an installer. The installer must detach the annular compression sleeve from the connector, slide the compression sleeve over the end of the coaxial cable, then install the connector, and finally compress the compression sleeve into the body of the connector. During assembly, the compression sleeve can easily become lost. In addition, such "Snap-n-Seal" connectors are significantly more expensive than conventional crimp style connectors. Moreover, such "Snap-n-Seal" connectors often exhibit excessive RF leakage of electromagnetic signals passing therethrough. In addition, because the annular compression sleeve of such "Snap-n-Seal" connectors must allow the coaxial cable to pass therethrough but must also compress the coaxial cable, the range of cable sizes that can be accommodated by any specific compression sleeve is limited.

It is known in the coaxial cable field generally that collars or sleeves within a coaxial cable connector can be compressed inwardly against the outer surface of a coaxial cable to secure a coaxial cable connector thereto. For example, in U.S. Pat. No. 4,575,274 to Hayward and assigned to Gilbert Engineering Company Inc., a connector assembly for a signal transmission system is disclosed wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, the connector shown in the Hayward '274 patent is much more expensive than conventional F-connectors and can not be installed quickly, as by a simple crimp or compression tool; rather, the mating threads of such connector must be tightened, as by using a pair of wrenches.

Accordingly, it is an object of the present invention to provide a simple and inexpensive F-connector that can be quickly installed using conventional F-connector installation tools.

It is another object of the present invention to provide such an F-connector that does not require any threaded, rotational movement of the connector components during installation in order to secure such connector over the end of the coaxial cable.

It is still another object of the present invention to provide such an F-connector which forms a reliable moisture proof seal between the F-connector and the jacket of the coaxial cable to preclude moisture from passing between the F-connector and the jacket of the coaxial cable extending therein, while avoiding the need for gels or other sealing compounds.

It is a further object of the present invention to provide such an F-connector which minimizes RF leakage from such connector.

A still further object of the present invention to provide such an F-connector that is shipped to a user as a one-piece structure, and which is installed onto the end of a coaxial cable as a one piece structure without detachment of any components, in order to simplify the installation of such connector over the end of a coaxial cable, and to avoid the loss of detachable components.

Yet another object of the present invention is to provide such an F-connector that is capable of being used with a wide range of coaxial cable braids and still form a leakproof seal with the outer jacket of the coaxial cable.

These and other objects of the present invention will become more apparent to those skilled in the art as the description of the present invention proceeds.

SUMMARY OF THE INVENTION

Briefly described, and in accordance with the preferred embodiments thereof, the present invention relates to a coaxial cable F-connector for coupling the end of a coaxial cable to a threaded port. The F-connector of the present invention includes a tubular post having a first end adapted to be inserted into an exposed, prepared end of the coaxial cable. This first end of the tubular post extends around the dielectric of the coaxial cable but passes under the conductive grounding braid and jacket thereof. The tubular post includes a second opposing end.

The F-connector also includes a cylindrical body member having a first end with a first central bore that surrounds, but which is spaced apart from, the tubular post for receiving the conductive grounding braid and outer jacket of the coaxial cable. The second opposing end of the cylindrical body member has a second central bore coaxial with, but smaller in diameter than, the first central bore for encircling and engaging the second end of the tubular post. The cylindrical body member further includes a generally cylindrical outer wall of a given diameter and having a series of spaced annular ridges formed thereupon. A nut rotatably engages the second ends of the tubular post and cylindrical body member, the nut including an internally threaded bore for threadedly engaging the aforementioned threaded port.

The F-connector of the present invention also includes a collar assembly having a central passage therein. A first end of the collar assembly includes a first internal bore forming a portion of the central passage; the inner diameter of this first internal bore is commensurate with the diameter of the outer wall of the cylindrical body member. Like the outer wall of the cylindrical. body member, the first internal bore of the collar assembly has a series of spaced annular ridges formed thereupon; as explained below, ridges of the first internal bore of the collar assembly are adapted to engage the ridges formed on the outer wall of the cylindrical body member; under sufficient pressure, these ridges can slide across one another to form an interlocking fit. The collar assembly includes an opposing second end which includes a second internal bore forming a portion of the central passage; this second internal bore is of sufficient diameter to permit the jacket of the coaxial cable to extend therethrough.

The F-connector further includes a wedging member supported by and extending within the central passage of the collar assembly and directed toward the first end of the collar assembly. This wedging member is preferably in the form of an annular gripping ring supported at a first end by the collar assembly, with the opposing second end extending freely toward the first end of the collar assembly; such annular gripping ring has a central bore adapted to receive the outer jacket of the coaxial cable.

The first end of the collar assembly is mounted on the first end of the cylindrical body member. During installation, the spaced annular ridges formed upon the first internal bore can be forced over the spaced annular ridges formed upon the outer wall of the cylindrical body member, as by compression with a conventional axial compression tool. The spaced annular ridges formed upon the first internal bore of the collar assembly and upon the outer wall of the cylindrical body member effectively form interlocking gripping teeth that are forced to slide across each other when the collar assembly is compressed over the body member. These gripping teeth resist removal of the collar assembly from the body member following such compression. During such compression, the first end of the cylindrical body member is received within the volume bounded by the annular gripping ring and the first internal bore; the first end of the cylindrical body member engages the annular gripping ring and radially compresses it against the jacket of the coaxial cable inwardly toward the tubular post.

In a first embodiment of the present invention, the annular gripping ring is integral with the collar assembly; these components can be molded or machined from plastic. To further improve the sealing capabilities of such connector, the collar assembly may include a resilient O-ring disposed adjacent, and just behind, the first end of the annular gripping ring. Compression of the collar assembly over the cylindrical body member causes the annular gripping ring to pivot, and this pivoting action of the annular gripping ring in turn causes compression of the resilient O-ring to form a seal between the collar assembly and the jacket of the coaxial cable. Preferably, a further O-ring is positioned around the annular gripping ring; this further O-ring is directly compressed by the first end of the cylindrical body member to form a seal between the cylindrical body member and the collar assembly.

In a second embodiment of the invention, the annular gripping ring is a separate piece inserted within the collar assembly. As in the case of the first embodiment, the sealing capabilities of such connector can be improved by including a resilient O-ring disposed adjacent, and just behind, the first end of the annular gripping ring. Compression of the collar assembly over the cylindrical body member forces the annular gripping ring to move toward the second end of the collar assembly, thereby compressing the resilient O-ring between the annular gripping ring and the collar assembly. The compressed 0-ring thereby forms a seal between the collar assembly and the jacket of the coaxial cable. Preferably, the outer wall of the cylindrical body member has a groove formed therein, and a further O-ring is seated in such groove for engaging the first internal bore of the collar assembly to form a seal between the cylindrical body member and the collar assembly.

As will be described in greater detail below, the aforementioned annular gripping ring can be made of metal stock, and in such instance, the second end of such annular gripping ring preferably has two or more longitudinally extending slots formed therein for dividing the second end of the annular gripping ring into a corresponding number of arcuate wedging fingers; each of such arcuate wedging fingers is radially compressed inward against the jacket of the coaxial cable as the first end of the cylindrical body member advances over and about such arcuate wedging fingers. To facilitate pivotal movement of such arcuate wedging fingers, the annular gripping ring preferably has an annular groove formed therein dividing the first and second ends of the annular gripping ring; the aforementioned longitudinal slots extend from the second end of the annular gripping ring to the annular groove. The annular groove forms a weakened portion of the annular gripping ring about which the arcuate wedging fingers can more easily pivot inwardly toward the tubular post during compression. Such pivotal movement can further be enhanced by forming the first end of the cylindrical body member to include a beveled portion extending from the first central bore outwardly toward the outer wall thereof; this beveled portion serves to cam the arcuate wedging fingers against the jacket of the coaxial cable inwardly toward said tubular post.

Another aspect of the present invention relates to the method of attaching the described coaxial cable F-connector to the end of a coaxial cable. In practicing such method, the first end of the collar assembly is partially advanced over the first end of the cylindrical body member prior to installation of the connector for allowing at least one of the annular ridges of the collar assembly to slide past at least one of the annular ridges of the cylindrical body member, thereby mounting the collar assembly upon the cylindrical body member; thus, as supplied to the user, the F-connector is a single piece. During installation, the F-connector is slipped over the end of the coaxial cable, collar assembly end first, for allowing the coaxial cable to extend through the central passage of the collar assembly, into the cylindrical body member, and partially into the tubular post; at this stage, the center conductor and dielectric of the coaxial cable extend through the tubular post, and the outer jacket and grounding braid of the coaxial cable extend into the first central bore of the cylindrical body member. Thereafter, the first end of the collar assembly is further advanced, as by a hand-operated axial compression tool, over the first end of the cylindrical body member for allowing the series of annular ridges of the collar assembly to slide past the series of annular ridges of the cylindrical body member. This compression operation simultaneously forces the first end of the cylindrical body member against the wedging member (which, again, may be in the form of an annular gripping ring) to radially compress the wedging member against the jacket of the coaxial cable inwardly toward the tubular post.

DETAILED DESCRIPTION OF THE PREFERRED EMBODIMENTS

Figure 1:
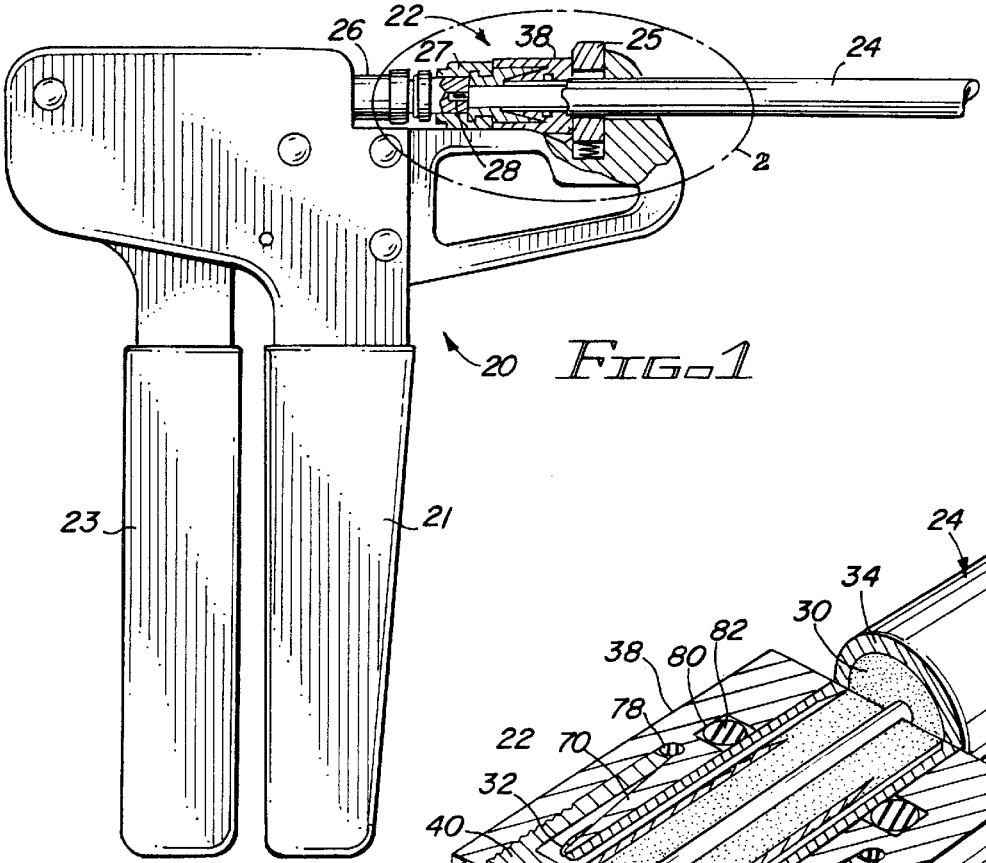
FIG. 1 is a partial sectional view of a pistol grip axial compression tool being used to secure the improved F-connector of the present invention onto the prepared end of a coaxial cable.

In FIG. 1, a pistol grip compression tool 20 is shown while being used to secure an improved F-connector 22, of the type embodying the present invention, onto the prepared end of a coaxial cable 24. F-connector 22 is designed for coupling the end of coaxial cable 24 to a threaded port (not shown), and includes a nut 27 that is internally threaded for engaging such a threaded port. Coaxial cable 24 includes a center conductor 28 for carrying a transmitted signal.

Figure 2:
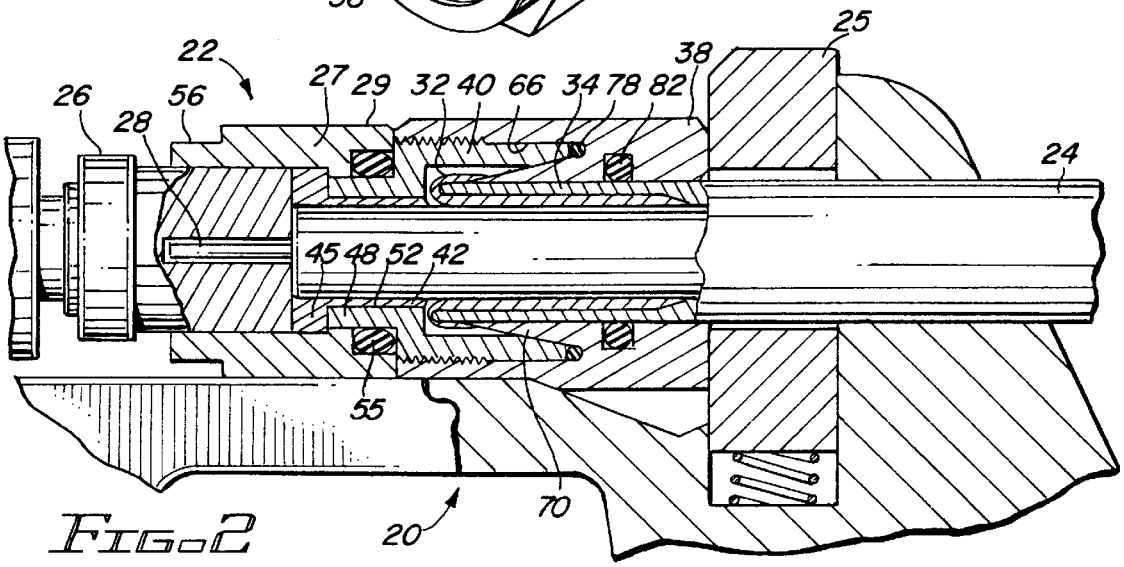
FIG. 2 is an enlarged sectional view of the area encircled by dashed oval 2 within FIG. 1, and showing a first embodiment of the present invention after having been fully compressed by the axial compression tool.

Compression tool 20 may be of the type commercially available from the CablePrep division of Ben Hughes Communication Products Company of Chester, Connecticut, under the commercial designation "Terminx". Compression tool 20 includes a pair of levers or handles 21 and 23, as well as a spring-loaded connector yoke 25 for releasably holding connector 22 and cable 24 in place during compression of connector 22. Compression tool 20 also includes a movable ram 26 that is adapted to extend within the nut of an F-connector, while allowing the bared center conductor 28 of coaxial cable 24 to extend therein without interference. FIG. 2 shows connector yoke 25 and movable ram 26 in greater detail. Movable ram 26 is forced toward connector yoke 25 when handle grips 21 and 23 are squeezed together by the user, thereby compressing together the components of the F-connector 22 captured therebetween.

Figure 3:
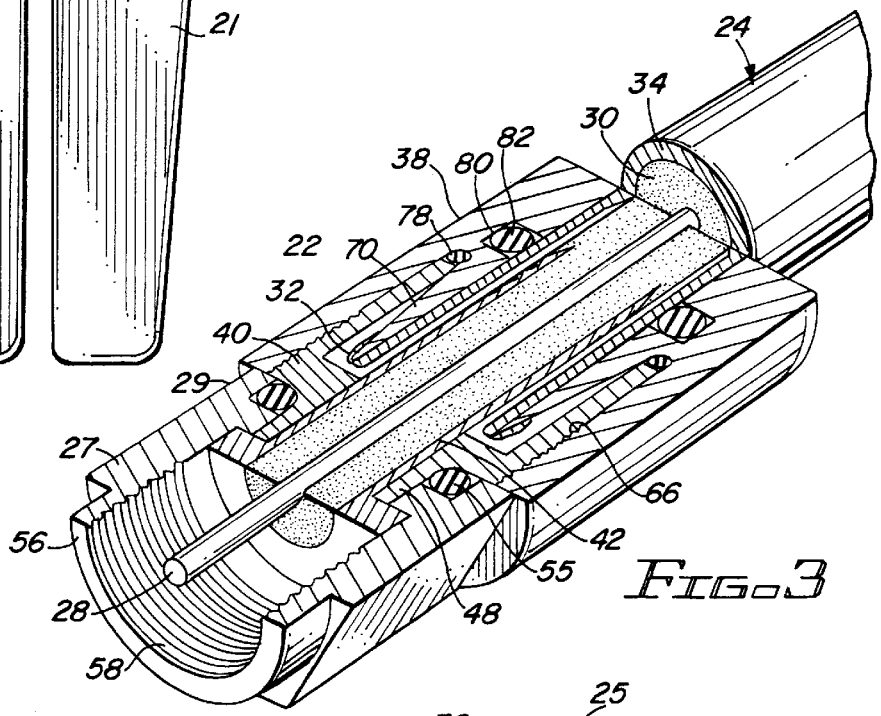
FIG. 3 is a partially cut away perspective view of the end of a coaxial cable after an improved F-connector, constructed in accordance with such first embodiment of the present invention, is secured thereto.

The particular F-connector shown in FIGS. 1 and 2 of the patent drawings corresponds to a first embodiment of the present invention. This first embodiment of the present invention is illustrated in greater detail in FIGS. 3 and 8–10. Before further describing F-connector 22, a brief description of coaxial cable 24 is appropriate. As shown best in FIGS. 2 and 3, coaxial cable 24 includes center conductor 28 surrounded by a dielectric layer 30. Dielectric layer 30 is, in turn, surrounded by a conductive grounding braid 32; in some cases, a thin film of metallic foil underlines conductive grounding braid 32. Conductive grounding braid 32 of coaxial cable 24 is itself surrounded by a protective plastic outer jacket 34. As indicated in FIGS. 2 and 3, the end of coaxial cable 24 is prepared, prior to installation of F-connector 22, by stripping all surrounding materials away from the tip of center conductor 28, and by removing the outer jacket 34 from a section of the grounding braid 32 and dielectric layer 30 just behind the exposed tip of center conductor 28. The exposed portion of grounding braid 32 is then typically bent back over outer jacket 34.

Figures 4, 5, 6, 7, 8:
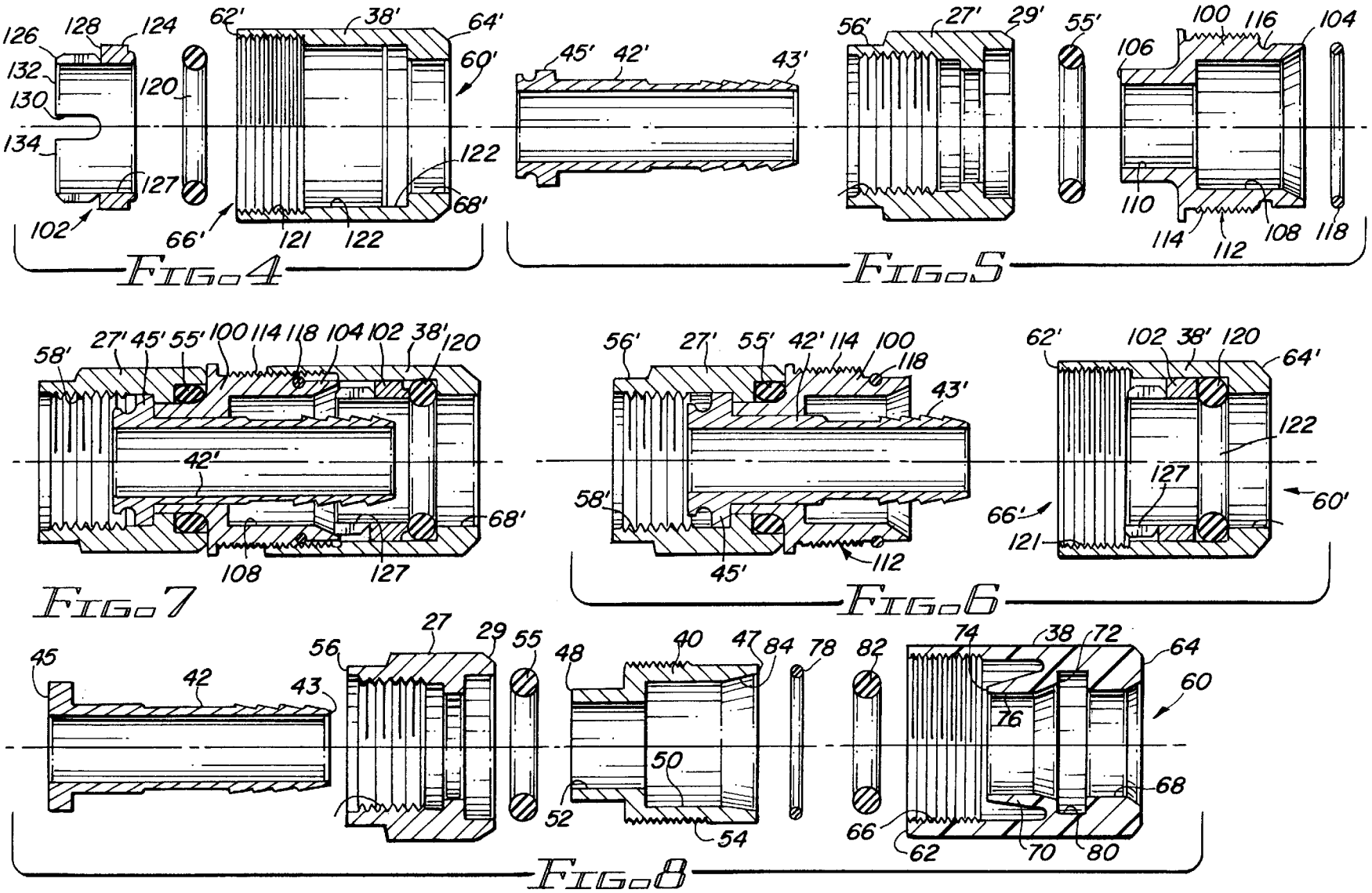
FIG. 4 is an exploded sectional view of the components forming a collar assembly used in providing an improved F-connector in accordance with a second embodiment of the present invention.
FIG. 5 is an exploded sectional view of the nut, cylindrical body member and tubular post used in providing an improved F-connector in accordance with the second embodiment of the present invention.
FIG. 6 is a sectional view showing the assembled collar assembly of FIG. 4 and the assembled nut, body and post of FIG. 5, respectively.
FIG. 7 is a sectional view showing the components of FIG. 6 partially assembled to each other in preparation for insertion over the prepared end of a coaxial cable prior to compression.
FIG. 8 is an exploded sectional view of the components forming the nut, post body, and collar assembly for the first embodiment of the present invention illustrated in FIGS. 2 and 3.
Figure 9:
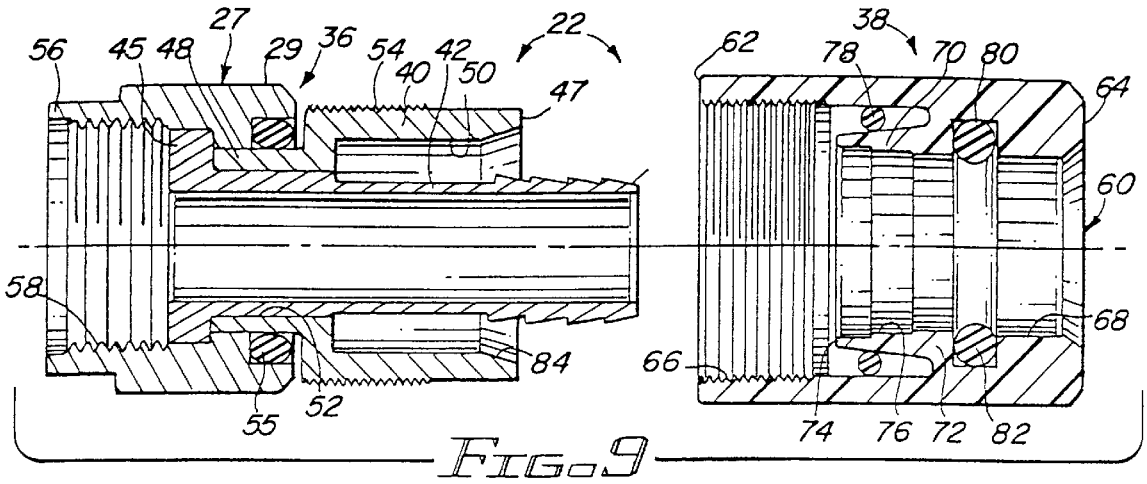
FIG. 9 is a sectional view illustrating the nut, post and body of FIG. 8 following assembly, and also illustrating the collar assembly of FIG. 8 following assembly.
Figure 10:
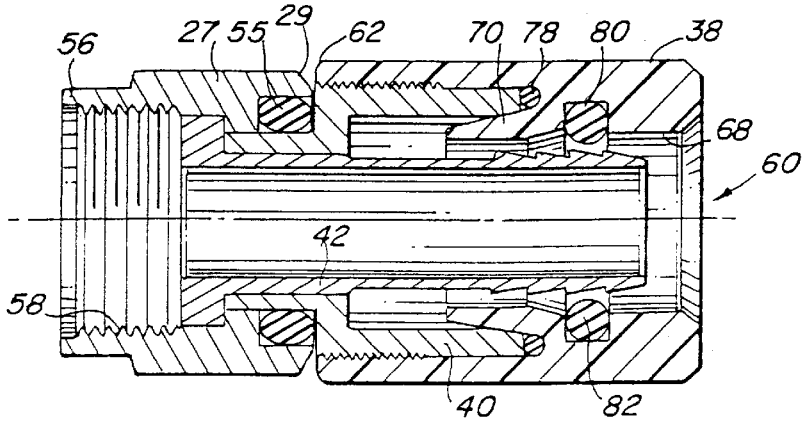
FIG. 10 is a sectional view of the two assemblies shown in FIG. 9 following compression of the collar assembly over the cylindrical body member of the connector.

As shown best in FIG. 9, F-connector 22 consists of two basic components designated generally by reference numerals 36 and 38. Component 36 is itself composed of three basic pieces, nut 27, cylindrical body member 40, and tubular post 42. Referring to FIGS. 8 and 9, tubular post 42 has a first end 43 adapted to be inserted into the prepared, exposed end of coaxial cable 24. The inner bore of tubular post 42 is sized to allow first end 43 of tubular post 42 to extend around the dielectric layer 30 of coaxial cable 24. The outer surface of tubular post 42 is preferably barbed as shown in FIGS. 8 and 9, and is sized to slide below conductive grounding braid 32 and outer jacket 34 as F-connector 22 is inserted over the prepared end of coaxial cable 24. Tubular post 42 includes a second opposing end 45.

Still referring to FIGS. 2, 3, and 8–the cylindrical body member 40 of F-connector 22 has a first end 47 and an opposing second end 48. First end 47 of cylindrical body member 40 includes a first central bore 50 which generally encircles tubular post 42 but which is spaced therefrom. As shown in FIGS. 2 and 3, the space bounded between central bore 50 of cylindrical. body member 40 and tubular post 42 receives conductive grounding braid 32 and outer jacket 34 of coaxial cable 24. At the opposing second end 48 of cylindrical body member 40, a second central bore 52 is formed coaxial with, but smaller in diameter than, first central bore 50; the smaller second central bore 52 encircles and engages the second end 45 of the tubular post 42. Cylindrical body member 40 includes a generally cylindrical outer wall 54 (see FIGS. 8 and 9) of a given diameter and having a series of spaced annular ridges formed thereupon, the purpose of which is later described.

The first component 36 of F-connector 22 also includes a nut 27 which has a first end 29 that rotatably second engages end 45 of tubular post 42 as well as second end 48 of cylindrical body member 40. A rubber sealing ring 55 is preferably captured between first end 29 of nut 27 and second end 48 of cylindrical body member 40 to form a seal between nut 27 and cylindrical body member 40. The opposing second end 56 of nut 27 includes an internally threaded bore 58 for threadedly engaging a threaded port. As indicated in FIG. 9, the tubular post 42, cylindrical body member 40, and fastening nut 27 are press-fit together during manufacture to form a single unit 36.

The second basic component 38 shown in FIGS. 2, 3, 9 and 10 is a collar assembly, the purpose of which is to firmly secure first component 36 onto the end of coaxial cable 24. In this first embodiment, collar assembly 38 is formed of a plastic; the preferred plastic material is that commercially available under the trademark "Delrin". Collar assembly 38 has a central passage 60 extending therethrough between the first end 62 and the second end 64 of collar assembly 60. First end 62 of collar assembly 38 has a first internal bore 66 that forms a portion of central passage 60. First internal bore 66 has an inner diameter that is commensurate with the outer diameter of the outer wall 54 of cylindrical body member 40; this internal bore 66 has a series of spaced annular ridges formed thereupon; the spacing, depth, and pitch of such ridges is preferably identical to the spacing, depth and pitch of the corresponding ridges formed on outer wall 54 of cylindrical body member 40.

The second end of collar assembly 38 has a second internal bore 68 forming a portion of the central passage 60. As shown in FIGS. 3, 8 and 9, second internal bore 68 is of a smaller diameter than first internal bore 66, but is still of sufficient diameter to permit jacket 34 of coaxial cable 24 to extend therethrough.

Collar assembly 38 also includes a wedging member that extends within central passage 60 for selectively wedging against the outer jacket 34 of coaxial cable 24. In this first embodiment of the present invention, the wedging member is in the form of an annular gripping ring 70 that is integral with collar assembly 38, i.e., formed of the same Delrin-brand plastic as the remainder of collar assembly 38. Gripping ring 70 has a first end 72 supported by collar assembly 38; the opposing second end 74 of gripping ring 70 extends freely toward first end 62 of collar assembly 38 without further support. Gripping ring 70 includes a central bore 76 for receiving the outer jacket 34 of coaxial cable 24. As indicated in FIG. 9, central bore 76 of gripping ring 70 can have a stepped surface to enhance the ability of gripping ring 70 to engage outer jacket 34 of coaxial cable 24.

As shown best in FIGS. 8 and 9, internal bore 66 of collar assembly 38 and the outer wall of gripping ring 70 define a volume that ultimately receives the first end 47 of cylindrical body member 40. For reasons which will soon become apparent, a resilient O-ring 78 is preferably inserted within such volume before collar assembly 38 is secured over cylindrical body member 40. As is further illustrated in FIG. 9, a radial groove 80 is preferably formed in central passage 60 of collar assembly 38 just behind and bordering first end 72 of gripping ring 70; a further O-ring 82 is inserted in groove 80 for reasons explained below.

While FIG. 9 illustrates F-connector 22 as having two basic components 36 and 38, the first internal bore 66 of collar assembly 38 is preferably engaged slightly over first end 47 of cylindrical body member 40 during the manufacture of F-connector 22 to form a one-piece assembly. In this regard, during manufacture, first end 62 of collar assembly 38 is adapted to engage and receive first end 47 of cylindrical body member 40, whereby perhaps one or two of the annular ridges formed upon first internal bore 66 can be forced over the first one or two annular ridges formed upon outer wall 54 of cylindrical body member 40. The engagement between such ridges prevents collar assembly 38 from being easily disengaged from cylindrical body member 40 during shipment or handling.

When a cable television technician is ready to install F-connector 22 onto the end of a drop cable 24, the prepared end of coaxial cable 24 is first inserted into second internal bore 68 of collar assembly 38; as the cable is pushed further into F-connector 22, outer jacket 34 slides past sealing ring 82, through central bore 76 of annular gripping ring 70, through first internal bore 66, and into first central bore 50 of cylindrical body member 40. Simultaneously, first end 43 of tubular post 42 penetrates below conductive braid 32 and passes into the prepared end of coaxial cable 24. Likewise, bared center conductor 28 and stripped dielectric layer 30 extend into and through tubular post 42. The technician ordinarily applies a half twisting motion to the cable to ensure that the end of the cable is firmly seated within F-connector 22. The result is similar to that shown in FIG. 3, except that collar assembly 38 is not yet fully compressed over cylindrical body member 40.

At this stage, the technician is ready to compress F-connector 22 to lock it onto the end of coaxial cable 24. F-connector 22 is supported within compression tool 20 in the manner shown in FIGS. 1 and 2, and handle grips 21 and 23 are squeezed. Collar assembly 38 is held fixed, while movable ram 26 is forced to the right (relative to FIGS. 1 and 2), forcing unit 36 (nut 27, tubular post 42, and cylindrical body member 40) and cable 24 to the right as well. This movement causes the ridges on outer wall 54 of cylindrical body member 40 to slide under the ridges of first internal bore 66 of collar assembly 38, thereby collapsing F-connector 22 to the fully-compressed position shown in FIGS. 2, 3 and 10. The series of ridges formed upon outer wall 54 of cylindrical body member 40 and upon first internal bore 66 of collar assembly 38 function as interlocking gripping teeth that are forced to slide across each other during axial compression of F-connector 22, and which resist removal of collar assembly 38 from cylindrical body member 40 following such compression.

As F-connector 22 is compressed, the first end 47 of cylindrical body member 40 is simultaneously forced between first internal bore 66 and annular gripping ring 70 of collar assembly 38. First end 47 of cylindrical body member 40 preferably includes a beveled portion 84 extending from first central bore 50 outwardly toward outer wall 54; beveled portion 54 functions as a cam to wedge second end 74 of annular gripping ring 70 inwardly against jacket 34 of coaxial cable 24, thereby compressing jacket 34 and the underlying grounding braid 32 tightly against the outer wall of tubular post 42.

As mentioned above, O-ring 78 is disposed about annular gripping ring 70. During compression of F-connector 22, first end 47 of cylindrical body member forces O-ring 78 toward first end 72 of annular gripping ring 70; further compression causes first end 47 of cylindrical body member 40 to engage and compress O-ring 78 to form a seal between cylindrical body member 40 and collar assembly 38.

Likewise, it will be recalled that O-ring 82 is seated within annular groove 80 just behind and adjacent the first end 72 of annular gripping ring 70. Referring to FIGS. 8 and 9, annular gripping ring 70 appears, in cross-section, similar to a shoe wherein second end 74 is the toe, and first end 72 includes a heel that abuts O-ring 82. As annular gripping ring 70 is cammed inwardly against jacket 34 of coaxial cable 24, the heel at first end 72 pivots toward, and compresses, O-ring 82, thereby forming a reliable moisture-proof seal between collar assembly 38 and outer jacket 34 of coaxial cable 24.

The second preferred embodiment of the present invention is shown in FIGS. 4–7 of the drawings. The second embodiment differs from the first embodiment already described primarily in that the annular gripping ring is not integral with the collar assembly, and in that all of the components forming the F-connector, apart from the sealing rings, are formed of metal. Those components used in the second embodiment that correspond to components already described in conjunction with the first embodiment illustrated in FIGS. 1–3 and 8–10 are designated by like primed reference numerals.

As in the case of the first embodiment, the F-connector of the second embodiment includes two basic units. The first unit is shown in exploded view in FIG. 5 and includes nut 27', tubular post 42', and a modified cylindrical body member 100. The second unit is shown in exploded view in FIG. 4 and includes the collar assembly 38' and a non-integral annular gripping ring 102.

The tubular post 42' and nut 27' of the first unit shown in FIG. 5 are essentially identical to those already described above in conjunction with the first embodiment of the present invention. Cylindrical body member 100 includes a first end 104, an opposing second end, a first central bore 108, a second central bore 110, and a generally cylindrical outer wall 112. Outer wall 112 includes a series of spaced annular ridges 114 formed thereupon. As indicated in FIG. 6, these components of the first unit are press-fit together during manufacture, wherein the first central bore 108 encircles, but is spaced apart from, of tubular post 42'; the volume bounded by central bore 108 and tubular post 42' ultimately receives the conductive grounding braid 32 and outer jacket 34 of the coaxial cable 24. Second central bore 110 is coaxial with, but smaller in diameter than, first central bore 108; as shown in FIG. 6, upon assembly, second central bore 110 encircles and engages tubular post 42' proximate second end 45' thereof.

Outer wall 112 of cylindrical body member 100 has a circular groove 116 formed therein, as shown in FIG. 5. Groove 116 is adapted to receive a resilient O-ring 118 which become seated in such groove. As will be explained in greater detail below, O-ring 118 engages collar assembly 38' during final assembly to form a seal between cylindrical body member 100 and collar assembly 38'.

The second unit shown in FIG. 4 includes collar assembly 38', gripping ring 102, and a resilient O-ring 120. Collar assembly 38' has a central passage 60' which extends between first end 62' and second end 64' thereof. As in the case of the first embodiment, central passage 60' includes a first internal bore 66' at first end 62' thereof and a second internal bore 68' at the second end 64' thereof. First internal bore 66' has an inner diameter commensurate with the outer diameter of outer wall 112 of cylindrical body member 100; as in the case of the first embodiment, first internal bore 66' includes a series of spaced annular ridges 121 formed thereupon which can be forced to slide across the corresponding spaced annular ridges 114 formed upon outer wall 112 of cylindrical body member 100. The innermost portion 119 of first internal bore 66' is relatively smooth. Second internal bore 68' is of smaller diameter than that of first internal bore 66' but is still of sufficient diameter to permit jacket 34 of coaxial cable 24 to extend therethrough. As shown in FIG. 4, a shallow groove 122 is formed in internal bore 66' adjacent the step transition between smooth portion 119 of first internal bore 66' and second internal bore 68'. Shallow groove 122 is used to seat O-ring 120.

The second unit shown in FIG. 4 also includes annular gripping ring 102 which is received within first internal bore 66' of collar assembly 38'; gripping ring 102 forms a loose fit with smooth walled portion 119 of first internal bore 66' and can move longitudinally therein. Gripping ring 102 has a first end 124 and an opposing second end 126. The inner bore 127 of gripping ring 102 is preferably smooth and of approximately the same diameter as for second internal bore 68' for allowing jacket 34 of coaxial cable 24 to pass therethrough. First end 124 has an outer diameter slightly undersized from the inner diameter of smooth walled portion 119 of first internal bore 66' to form the aforementioned loose fit. Gripping ring 102 has an annular groove 128 formed in the outer wall thereof dividing first end 124 from second end 126. Second end 126 has an outer wall of slightly reduced diameter as compared with first end 124. Thus, once gripping ring 102 is inserted within collar assembly 38', second end 126 extends freely toward first end 62' of collar assembly 38'.

Second end 126 of gripping ring 102 has at least two longitudinally extending slots formed therein, one of which is designated by reference numeral 130 in FIG. 4; each such slot 130 extends from second end 126 to annular groove 128. These longitudinally extending slots divide second end 126 of gripping ring 102 into a corresponding number of arcuate wedging fingers, such as 132 and 134. Annular groove 128 forms a weakened portion of gripping ring 102 about which such arcuate wedging fingers can pivot and bend inwardly. As will be explained in greater detail below, these wedging fingers are each radially compressed inwardly toward tubular post 42', and against jacket 34 of coaxial cable 24, when the F-connector is compressed.

The use and function of the F-connector assembled in accordance with the second embodiment shown in FIGS. 4–7 is similar to that described above in conjunction with the first embodiment. While FIG. 6 illustrates the F-connector as having two basic components, first internal bore 66' of collar assembly 38' is preferably engaged slightly over outer wall 112 of cylindrical body member 100 during the manufacture of the F-connector to form a one-piece assembly; first end 62' of collar assembly 38' receives first end 104 of cylindrical body member 100 to the extent of allowing one or two of ridges 121 of first internal bore 66' to be forced over the first one or two ridges 114 of outer wall 112. The engagement between such ridges prevents collar assembly 38' from being easily disengaged from cylindrical body member 100 during shipment or handling. The structure resulting from such manufacture has the general appearance shown in FIG. 7, except that collar assembly 38' has not been advanced as far over body member 100 as is indicated in FIG. 7.

During actual installation, the prepared end of coaxial cable 24 is first inserted into second internal bore 68' of collar assembly 38', past sealing ring 120, through bore 127 of gripping ring 102, through first internal bore 66', and into first central bore 108 of cylindrical body member 100. As before, the center conductor 28 and dielectric layer 30 of coaxial cable 24 slide into the central bore of tubular post 42', while first end 43' of tubular post 42' penetrates below conductive braid 32 and outer jacket 34. The F-connector and attached cable are then inserted into the compression tool 20 (see FIGS. 1 and 2) in the manner already described. As the compression tool handles are squeezed, ridges 114 on outer wall 112 of cylindrical body member 100 slide under ridges 121 of first internal bore 66', thereby allowing collar assembly 38' to advance further over body member 100.

As shown best in FIG. 7, the compression of the F-connector causes first end 104 of cylindrical body member 100 to cam arcuate wedging fingers 132 and 134 of gripping ring 102 inwardly toward the outer wall of tubular post 42'. Assuming that the end of coaxial cable 24 (see FIG. 3) is installed within the F-connector shown in FIG. 7, then the further compression of collar assembly 38' over body member 100 wedges the arcuate fingers 132 and 134 of gripping ring 102 tightly against jacket 34 of coaxial cable 24, thereby compressing jacket 34 and the underlying grounding braid 32 against the barbed outer surface of tubular post 42'. At the same time, the engagement of gripping ring 102 by first end 104 of body member 100 forces gripping ring 102 to move to the right, relative to FIG. 7, thereby compressing O-ring 120 and forming a moisture tight seal between collar assembly 38' and the outer jacket 34 of coaxial cable 24. Meanwhile, O-ring, 118 is captured between outer wall 112 of body member 100 and first internal bore 66' of collar assembly 38', forming a moisture tight seal between such components.

From the foregoing detailed description of the two preferred embodiments, those skilled in the art will also appreciate that an improved method of attaching an F-connector to the end of a coaxial cable has been described as well. In practicing such method, one provides a series of spaced annular ridges or teeth upon the outer wall of the F-connector body member. The method also includes the step of providing a collar assembly, like those designated 38 and 38', having a first internal bore formed in a first end of the collar assembly and having an inner diameter commensurate with the outer diameter of the body member. A series of spaced annular ridges, like those designated 121, is formed upon the first internal bore of the collar assembly to frictionally engage the corresponding ridges of the body member. The method of the present invention further includes the step of providing a wedging member, preferably in the form of an annular gripping ring, like those designated 70 and 102, within the central passage of the collar assembly, and directed toward the first end of the collar assembly.

In practicing the preferred embodiment of the improved method, the first end of the collar assembly is partially advanced over the first end of the body member for allowing at least one of the annular ridges of the collar assembly to slide past ac least one of the annular ridges of the body member, in order to mount the collar assembly upon the body member, and form a single unit. During installation of the F-connector, the collar assembly end of the F-connector is slipped over the prepared end of the coaxial cable for allowing the coaxial cable to extend through the central passage of the collar assembly and into the tubular post and body member. The collar assembly is then further advanced over the body member for causing the ridges of the collar assembly to slide past the ridges of the body member, while simultaneously forcing the first end of the body member against the wedging member to radially compress the wedging member against the jacket of the coaxial cable inwardly toward the tubular post.

Those skilled in the art will now appreciate that an improved F-connector has been described for coupling the end of a coaxial cable to a threaded post wherein such F-connector is simple and inexpensive to manufacture, and which can be quickly installed using conventional F-connector compression tools. The described F-connector does not require any threaded, rotational movement of the connector components during installation in order to secure such connector over the end of the coaxial cable. The F-connector of the present invention forms a reliable moisture proof seal between the F-connector and the jacket of the coaxial cable without the need for gels or other sealing compounds. Moreover, initial tests performed by the applicant indicate that the described F-connector minimizes stray RF leakage from such connector. The F connector disclosed herein is provided to technicians for installation as a one-piece structure, without any detachable components, thereby simplifying installation. Moreover, because of the camming action of the body member against the gripping ring, the disclosed F-connector is capable of being used with a wide range of coaxial cable braids. While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A connector for coupling the end of a coaxial cable to a threaded port, the coaxial cable having a center conductor surrounded by a dielectric, the dielectric being surrounded by a conductive grounding braid, and the conductive grounding braid being surrounded by a protective outer jacket, said connector comprising in combination:

a. a tubular post having a first end adapted to be inserted into an exposed end of the coaxial cable around the dielectric thereof and under the conductive grounding braid thereof, said tubular post having an opposing second end;

b. a cylindrical body member having a first end and a second end, the first end of said cylindrical body member having a first central bore for encircling said tubular post and for receiving the conductive grounding braid and outer jacket of the coaxial cable, the second end of said cylindrical body member having a second central bore coaxial with, but smaller in diameter than, said first central bore for encircling and engaging said tubular post proximate the second end thereof, said cylindrical body member including a generally cylindrical outer wall of a first predetermined diameter, said outer wall having a plurality of spaced annular ridges formed thereupon;

c. a nut having a first end for rotatably engaging the second end of said tubular post and the second end of said cylindrical body member, said nut having an opposing second end with an internally threaded bore for threadedly engaging the threaded port;

d. a collar assembly having a central passage therein extending between first and second opposing ends of said collar assembly, the first end of said collar assembly having a first internal bore forming a portion of the central passage, the first internal bore having an inner diameter commensurate with the first predetermined diameter of the cylindrical outer wall of said cylindrical body member, the first internal bore having a plurality of spaced annular ridges formed thereupon, the second end of said collar assembly having a second internal bore forming a portion of the central passage, the second internal bore being of sufficient diameter to permit the jacket of the coaxial cable to extend therethrough;

e. a wedging member extending within the central passage of said collar assembly and directed toward the first end of said collar assembly; and f. the first end of said collar assembly being adapted to engage and receive the first end of said cylindrical body member whereby the spaced annular ridges formed upon said first internal bore can be forced over the spaced annular ridges formed upon the outer wall of said cylindrical body member, while simultaneously forcing the first end of said cylindrical body member to engage said wedging member to radially compress said wedging member against the jacket of the coaxial cable inwardly toward said tubular post.

2. The connector recited by claim 1 wherein said wedging member is an annular gripping ring having first and second ends, the first end of said annular gripping ring being supported by said collar assembly, the second end of said annular gripping ring extending freely toward the first end of said collar assembly, said annular gripping ring including a central bore for receiving the outer jacket of the coaxial cable, said annular gripping ring and said first internal bore defining a volume for receiving the first end of said cylindrical body member.

3. The connector recited by claim 2 wherein said annular gripping ring is integral with said collar assembly.

4. The connector recited by claim 3 wherein said collar assembly and said integral annular gripping ring are formed of plastic.

5. The connector recited by claim 2 wherein said collar assembly includes a resilient O-ring disposed adjacent the first end of said annular gripping ring, and wherein compression of said collar assembly over said cylindrical body member compresses said resilient O-ring to form a seal between said collar assembly and the jacket of the coaxial cable.

6. The connector recited by claim 2 including an O-ring disposed about said annular gripping ring proximate the first end thereof, wherein compression of said collar assembly over said cylindrical body member causes the first end of said cylindrical body member to engage and compress said O-ring to form a seal between said cylindrical body member and said collar assembly.

7. The connector recited by claim 1 wherein the outer cylindrical wall of said cylindrical body member has a groove formed therein, said connector including an O-ring seated in said groove for engaging the first internal bore of said collar assembly to form a seal between said cylindrical body member and said collar assembly.

8. The connector recited by claim 1 wherein said plurality of spaced annular ridges formed upon the outer wall of said body member and said plurality of spaced annular ridges formed upon said first internal bore form interlocking gripping teeth that are forced to slide across each other when said collar assembly is compressed over said cylindrical body member and which resist removal of said collar assembly from said cylindrical body member following such compression.

9. The connector recited by claim 2 wherein the second end of said annular gripping ring has a plurality of longitudinally extending slots formed therein for dividing the second end of said annular gripping ring into a corresponding plurality of arcuate wedging fingers that are each radially compressed inward against the jacket of the coaxial cable as the first end of said cylindrical body member advances over and about said arcuate wedging fingers.

10. The connector recited by claim 9 wherein said annular gripping ring has an annular groove formed therein dividing the first end of said annular gripping ring from the second end thereof, said plurality of longitudinally extending slots extending from the second end of said annular gripping ring to said annular groove, said annular groove forming a weakened portion of said annular gripping ring to facilitate the radial compression of said plurality of arcuate wedging fingers inwardly toward said tubular post.

11. The connector recited by claim 1 wherein the first end of said cylindrical body member includes a beveled portion extending from the first central bore thereof outwardly toward the outer wall thereof, the beveled portion of the first end of said cylindrical body member being, adapted to cam said wedging member against the jacket of the coaxial cable inwardly toward said tubular post.

12. A method of attaching a coaxial cable end connector to the end of a coaxial cable, the coaxial cable having a center conductor surrounded by a dielectric, the dielectric being surrounded by a conductive grounding shield, and the conductive grounding shield being surrounded by a protective outer jacket, and the coaxial cable end connector including a tubular post having a first end adapted to be inserted into an exposed end of the coaxial cable between the dielectric and outer jacket thereof and including a second opposing end, the coaxial cable end connector also including a cylindrical body member, the cylindrical body member having a first end including a first central bore therein for encircling the first end of the tubular post and for receiving the outer jacket of the coaxial cable, the cylindrical body member having a second end engaged with the second end of the tubular post, the cylindrical body member including a generally cylindrical outer wall of a first predetermined diameter, said method comprising the steps of:

a. providing a series of spaced annular ridges upon the outer wall of the cylindrical body member;

b. providing a collar assembly having a central passage extending therethrough from a first end of the collar assembly to a second end thereof, including a first internal bore formed in the first end of the collar assembly with an inner diameter commensurate with the first predetermined diameter of the outer wall of the cylindrical body member;

c. providing a series of spaced annular ridges upon the first internal bore of the collar assembly;

d. providing a wedging member within the central passage of the collar assembly, and directed toward the first end of the collar assembly;

e. partially advancing the first end of the collar assembly over the first end of the cylindrical body member for allowing at least one of the annular ridges of the collar assembly to slide past at least one of the annular ridges of the body member, thereby mounting the collar assembly upon the cylindrical body member;

f. slipping the collar assembly over the end of the coaxial cable for allowing the coaxial cable to extend through the central passage of the collar assembly and into the tubular post for allowing the center conductor and dielectric to extend through the tubular post and allowing the outer jacket to extend into the first central bore of the cylindrical body member;

g. further advancing the first end of the collar assembly over the first end of the cylindrical body member for allowing the series of annular ridges of the collar assembly to slide past the series of annular ridges of the cylindrical body member, while simultaneously forcing the first end of said cylindrical body member against the wedging member to radially compress the wedging member against the jacket of the coaxial cable inwardly toward the tubular post.

13. The method recited by claim 12 wherein the step of providing a wedging member includes the step of providing an annular gripping ring having first and second ends, and supporting the first end of the annular gripping ring within the internal passage of the collar assembly while allowing the second end of the annular gripping ring to extend freely toward the first end of the collar assembly, the annular gripping ring including a central bore for receiving the outer jacket of the coaxial cable, and wherein said further advancing step includes the step of forcing the first end of the cylindrical body member between the collar assembly and the annular gripping ring in order to radially compress the second end of the annular gripping ring against the jacket of the coaxial cable inwardly toward the tubular post.

14. The method recited by claim 13 wherein the step of providing the annular gripping ring includes the step of making the annular gripping ring integral with the collar assembly.

15. The method recited by claim 14 including the step of forming the collar assembly and integral annular gripping ring from plastic.

16. The method recited by claim 13 including the step of disposing a resilient O-ring adjacent the first end of the annular gripping ring, and wherein the step of forcing the first end of the cylindrical body member between the collar assembly and the annular gripping ring includes the step of urging the first end of the annular gripping ring against the resilient O-ring to compress the O-ring and to form a seal between the collar assembly and the jacket of the coaxial cable.

17. The method recited by claim 13 including the step of disposing an O-ring about the annular gripping ring, and wherein the step of forcing the first end of the cylindrical body member between the collar assembly and the annular gripping ring includes the step of compressing the O-ring to form a seal between the cylindrical body member and the collar assembly.

18. The method recited by claim 13 including the step of forming a groove in the outer cylindrical wall of the cylindrical body member and seating an O-ring within the groove for engaging the collar assembly within the first internal bore thereof to form a seal between the cylindrical body member and the collar assembly.

19. The method recited by claim 13 including the step of forming longitudinally extending slots in the second end of the annular gripping ring for dividing the second end at the annular gripping ring into a plurality of arcuate wedging fingers that are each radially compressed inward against the jacket of the coaxial cable as the first end of the cylindrical body member advances over and about the arcuate wedging fingers.

20. The method recited by claim 19 including the step of forming an annular groove within the annular gripping ring for dividing the first end of the annular gripping ring from the second end thereof and for forming a weakened portion of the annular gripping ring to facilitate the radial compression of the plurality of arcuate wedging fingers inwardly toward the tubular post.

21. The method recited by claim 13 including the step of forming a beveled portion on the first end of the cylindrical body member extending from the first central bore thereof outwardly toward the outer wall thereof, and wherein the step of forcing the first end of the cylindrical body member between the collar assembly and the annular gripping ring includes the step of camming the beveled portion of the first end of the cylindrical body member against the second end of the annular gripping ring.

* * * * *